US008016702B2

(12) United States Patent
Hagey

(10) Patent No.: US 8,016,702 B2
(45) Date of Patent: Sep. 13, 2011

(54) CONTOURED HAND GRIP CONSTRUCTIONS FOR A RACQUET

(76) Inventor: Edward H. Hagey, La Jolla, CA (US)

( * ) Notice: Subject to any disclaimer, the term of this patent is extended or adjusted under 35 U.S.C. 154(b) by 20 days.

(21) Appl. No.: 12/709,775

(22) Filed: Feb. 22, 2010

(65) Prior Publication Data

US 2010/0248870 A1 Sep. 30, 2010

Related U.S. Application Data

(60) Provisional application No. 61/154,265, filed on Feb. 20, 2009.

(51) Int. Cl.
*A63B 49/08* (2006.01)

(52) U.S. Cl. ..... 473/551; 473/549

(58) Field of Classification Search ..... 473/549, 473/551, 552, 298, 300, 568
See application file for complete search history.

(56) References Cited

U.S. PATENT DOCUMENTS 3,674,267 A * 7/1972 Hollis ..... 473/552
3,931,968 A * 1/1976 Hedberg ..... 473/552
4,101,125 A * 7/1978 Heath ..... 473/552
4,641,838 A * 2/1987 Gabrielidis ..... 473/552
5,492,324 A * 2/1996 Hagey ..... 473/551
5,524,879 A * 6/1996 Lyle ..... 473/552
5,671,926 A * 9/1997 Hagey ..... 473/549
5,924,941 A * 7/1999 Hagey ..... 473/551
6,017,283 A * 1/2000 Hagey ..... 473/551
6,033,325 A * 3/2000 Hong ..... 473/552
6,106,418 A * 8/2000 Hagey et al. ..... 473/551
6,213,902 B1 * 4/2001 Hagey et al. ..... 473/551
7,758,455 B2 * 7/2010 Thomas ..... 473/459
2008/0032832 A1 * 2/2008 Thomas ..... 473/549
2010/0248870 A1 * 9/2010 Hagey ..... 473/551

* cited by examiner

*Primary Examiner* — Raleigh W. Chiu
(74) *Attorney, Agent, or Firm* — Walter W. Duft

(57) ABSTRACT

A handle configuration for a stringed racquet includes a handle shaft having a defined exterior shape and plural mounting apertures, with a butt cap being provided at a base end thereof. A contour assembly has an exterior of designed contour, including an upper protrusion and a lower trigger. The contour assembly is mountable on the racquet handle shaft at a plurality of discrete locations defined by the mounting apertures. The contour assembly has an interior shape conforming to the handle shaft shape to allow the contour assembly to be received on the handle shaft for attachment thereto. One or more mounting elements on the contour assembly align with the handle shaft mounting apertures for attachment of the contour assembly thereto.

20 Claims, 8 Drawing Sheets

CONTOURED HAND GRIP CONSTRUCTIONS FOR A RACQUET

CROSS-REFERENCE TO RELATED APPLICATIONS

This applications claims benefit of the filing date under 35 U.S.C. 119(e) of U.S. Provisional Patent Application No. 61/154,265, filed on Feb. 20, 2009 and entitled "Tennis Racquet Contoured Hand Grip Constructions."

BACKGROUND

1. Field of the Invention

The present invention is directed to improvements in racquets for use in several sports, but is particularly directed toward providing an improved gripping area for a tennis racquet handle.

2. Description of the Prior Art

By way of background, of all the racquet sports, tennis is unique in its ball speed (pace) and the great deal of court coverage required by the players. Players must hit many balls, often on the run or after traveling great distances. For expert play, it is essential that during these maneuvers the player have a superb sense or awareness of the location and attitude (angular disposition) of the racquet head with respect to the player's hand. Sometimes the ball must be struck when it has little or no speed. At other times, the racquet will encounter high impact forces because of the pace with which the opponent has struck the ball. Additionally, the player must return tennis balls with various spins. The player is oftentimes required to change grips for each stroke.

Applicant has received U.S. Pat. Nos. 5,492,324, 5,671,926, 5,924,941, 5,931,749, 6,017,283, 6,106,418 and 6,213,902 in connection with his work in racquet handle design. The entire contents of each of these patents is incorporated herein by this reference. The referenced patents disclose racquet handles having various contours that can help position a player's hand and improve racquet control during forehand and backhand strokes. Applicant's contour designs accommodate a variety of grips without the loss of power or racquet head awareness. In some instances, an improper grip is assumed because of a lack of skill or because of the difficult circumstances encountered during a grip change. The patented racquet handle contours permit a considerable array of grips and at the same time aid the user in reaching a desired grip.

The present invention represents a continuation applicant's previous racquet handle design work. In particular, applicant has developed additional racquet handle constructions that allow a handle contour to be easily mounted on a conventional stringed racquet, especially a tennis racquet, and adjusted as necessary to suit individual player preferences.

SUMMARY

A handle configuration is provided for a racquet that supports a stringed racquet head at its outer end, and which has a racquet neck and is terminated at a handle base or butt end. The handle configuration includes a racquet handle shaft having a defined exterior shape and plural mounting apertures. A butt cap is provided at the butt end of the racquet handle shaft. A contour assembly has an exterior of designed contour, including an upper protrusion and a lower trigger. The contour assembly is mountable on the racquet handle shaft at a plurality of discrete locations defined by the mounting apertures. The upper protrusion is located at a top side of the racquet handle shaft and is angled with respect to a central longitudinal axis of the racquet handle shaft to provide a surface against which a saddle formed by an index finger and a thumb of a player's hand is placed. The lower trigger is located at a bottom side of the racquet handle shaft to provide a surface against which an index figure of a player's hand is placed. The contour assembly has an interior shape conforming to the handle shaft shape to allow the contour assembly to be received on the handle shaft for attachment thereto. One or more mounting elements on the contour assembly to align with the handle shaft mounting apertures for attachment of the contour assembly thereto.

According to first contour assembly embodiment, the contour assembly comprises a sleeve surrounding the racquet handle shaft. The sleeve is formed with a contour portion defining the upper protrusion and the lower trigger. The sleeve is further formed with a base portion defining a hand grip area for grasping the contour assembly with a hand while portions of the hand engage the upper protrusion and the lower trigger. The sleeve is slidably received in the butt cap such that the base portion can be lengthened or shortened according to a mounting position of the contour assembly on the racquet handle shaft.

According to a second contour assembly embodiment, the upper protrusion and the lower trigger respectively comprise an upper protrusion member and a lower trigger member formed as discrete structural members that are separately mountable to the racquet handle shaft. The upper protrusion member is formed as a raised ridge member and the trigger member is formed as a raised dome member with no ancillary structure being associated with either member, and with each such member having its own mounting element(s).

BRIEF DESCRIPTION OF THE DRAWINGS

The foregoing and other features and advantages of the invention will be apparent from the following more particular description of example embodiments, as illustrated in the accompanying Drawings, in which.

DETAILED DESCRIPTION OF EXAMPLE EMBODIMENTS

Figure 1:
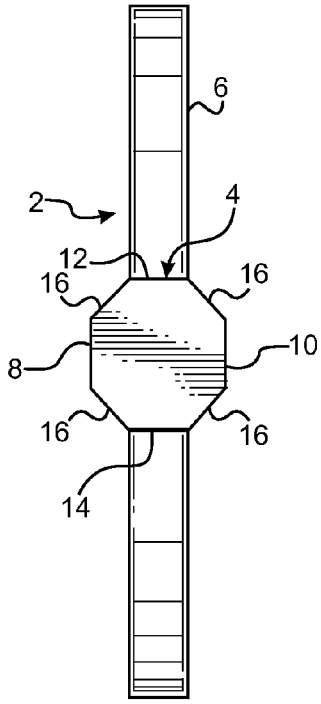
FIG. 1 (Prior Art)
FIG. 1 is an end view of a prior art racquet handle showing its orientation relative to a racquet head.

Turning now to the drawing figures, wherein like reference numerals are used to represent like elements in all of the several views, FIG. 1 illustrates a prior art racquet 2 that may be used for a racquet sport, such as tennis. The racquet 2 has an octagonal racquet handle shaft 4 and a racquet head 6. As is conventional, the longitudinal centerline of the handle shaft 4 (which is normal to the plane of FIG. 1) lies substantially on the midplane of the racquet head 6. Due to its octagonal configuration, the handle shaft 4 includes a left side surface 8, a right side surface 10, a top surface 12, a bottom surface 14, and four diagonal surfaces 16. Although not shown, a soft covering (such as tape, foam, etc.) would usually cover the exterior of the handle shaft 6 to provide a pliable, easily gripped handle surface on the racquet 2. The handle shaft 4 may be formed from a variety of materials, including wood, metal, fiberglass, graphite, etc.

Although the handle shaft 4 is shown as being substantially octagonal in FIG. 1, many other shapes could also be used, including but not limited to square, rectangular, elliptical, etc. If such alternative shapes are used for the handle shaft 4, a unitary handle piece of octagonal shape would normally be placed over and affixed to the handle shaft to provide the standard racquet handle configuration. Depending on the materials used, the handle shaft 4 can be solid, hollow, or some combination thereof. If desired, the handle shaft 4 could also be formed with plural (e.g., two or more) shaft members, again with a unitary handle piece being placed over and affixed to such shaft members. By way of example, this type of construction may be used if the racquet 2 is formed by a length of extruded material (e.g., a metal tube). In this construction, the midsection of the extrusion would be folded on itself to form a loop that defines the racquet head 6. The end sections of the extrusion that extend from the loop would be configured to adjacently parallel to each other to define the handle shaft 4.

Figure 3:
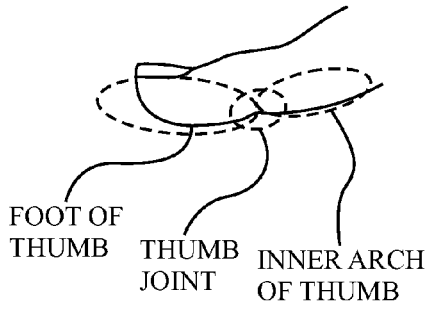
FIG. 3 (Prior Art)
FIG. 3 is a diagrammatic view showing finger anatomy for purposes of nomenclature.
Figure 4:
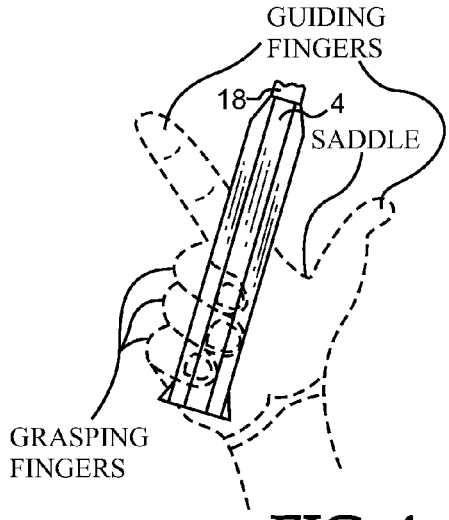
FIG. 4 (Prior Art)
FIG. 4 is a diagrammatic view showing a hand grasping the prior art racquet handle of FIG. 1.
Figure 2:
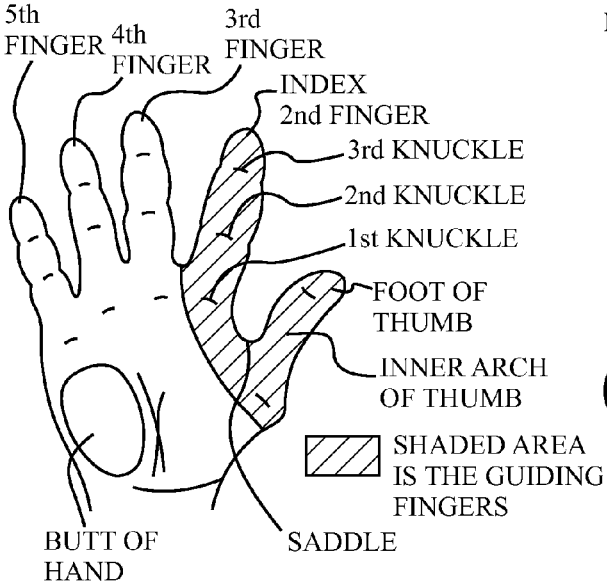
FIG. 2 (Prior Art)
FIG. 2 is a diagrammatic view showing hand anatomy for purposes of nomenclature.

Turning now to FIGS. 3-4, the anatomy of the human hand and fingers is illustrated for nomenclature purposes. In FIG. 2, the index finger, thumb, and the saddle area of the hand have been shaded. These hand portions contribute guidance and control to the player, particularly the foot of the thumb, the thumb joint and the inner arch of the thumb as shown in FIG. 3. The remaining third, fourth, and fifth fingers of the hand provide much of the grasping power. FIG. 4, which shows a hand being placed on the handle shaft 4, illustrates this concept. FIG. 4 further illustrates that the head end of the handle shaft 4 tapers down to a neck section 18 of the racquet 2. The neck section 18 is typically rectangular and extends from the head end of the handle shaft 4 to the racquet head 6.

Figure 5:
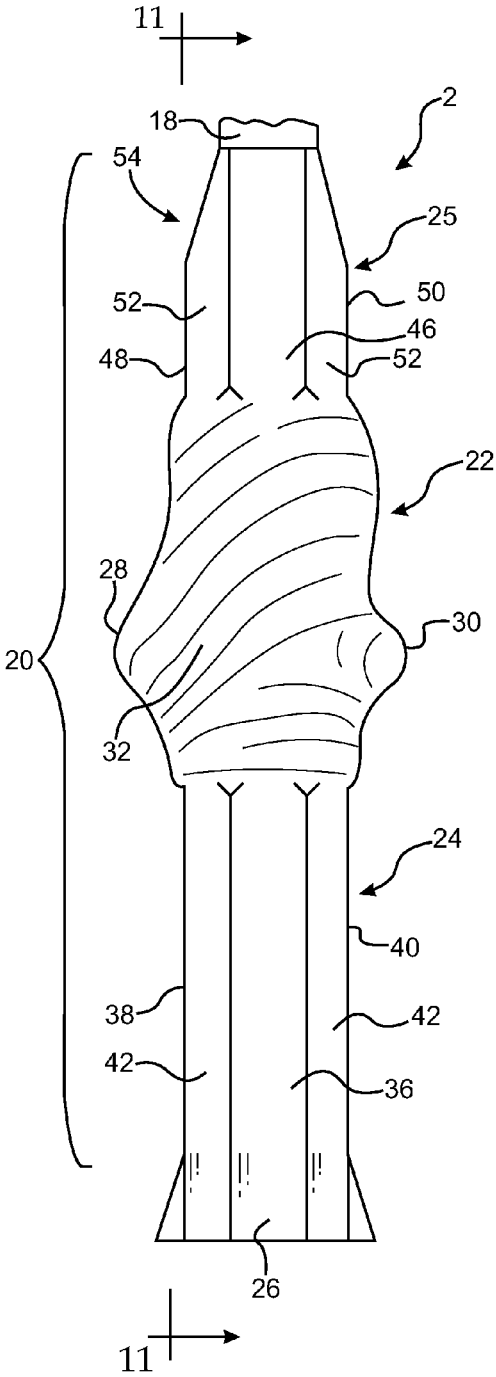
FIG. 5 is a right side view showing a racquet handle contour assembly mounted on a racquet handle shaft according to an example embodiment disclosed herein.
Figure 6:
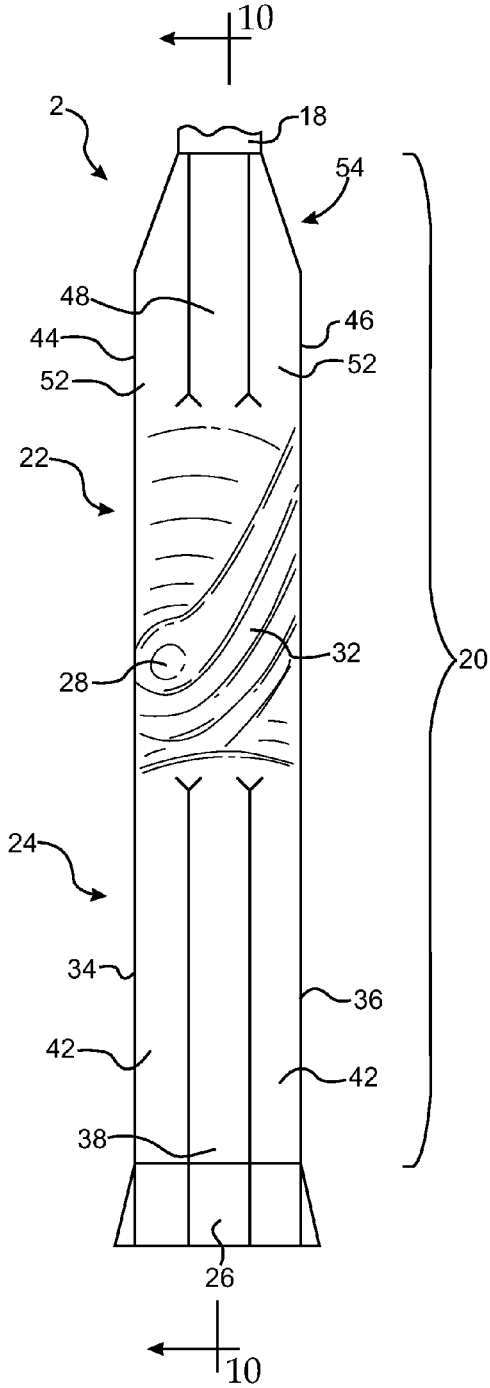
FIG. 6 is a top plan view showing the mounted racquet handle contour assembly of FIG. 5.

Turning now to FIGS. 5 and 6, the racquet 2 is shown with the handle shaft 4 being completely covered by a handle contour assembly 20. As described in more detail below in connection with FIGS. 10A-11B, the contour assembly 20 may be constructed as a sleeve structure that is slidably mounted on the handle shaft 4. The contour assembly 20 includes a contour portion 22, a base portion 24 and a head portion 25. The contour portion 22 is centrally located on the contour assembly 20. The base portion 24 extends from a base end of the contour portion 22 and has a base end that is not visible in FIGS. 5 and 6 because it is received inside a handle butt cap 26 that is mounted to the base or butt end of the handle shaft 4. The head portion 25 extends from a head end of the contour portion 22 to the junction of the handle shaft 4 and the neck section 18 of the racquet 2.

Figure 7:
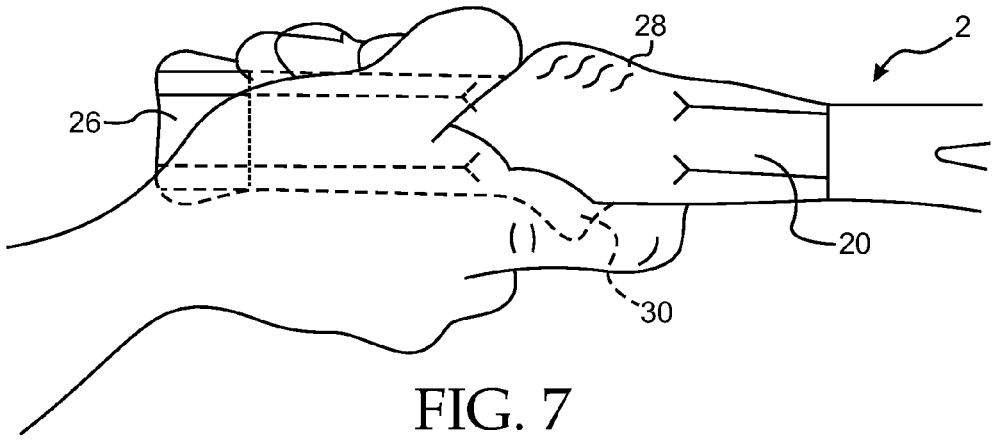
FIG. 7 is a right side view showing the mounted racquet handle contour assembly of FIG. 5 being grasped by a right hand.
Figure 8:
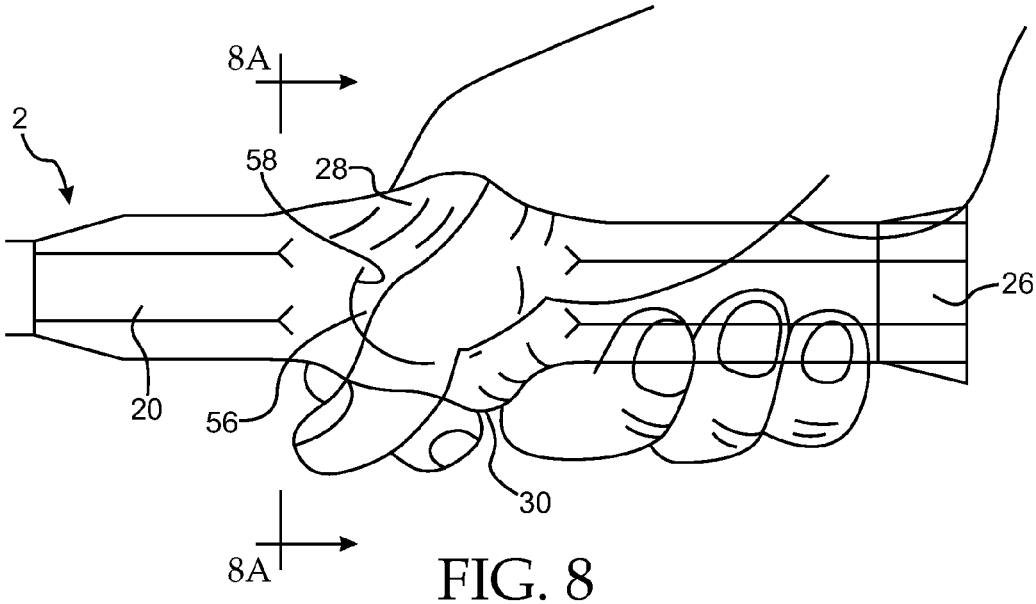
FIG. 8 is a left side view showing the mounted racquet handle contour assembly of FIG. 5 being grasped by a right hand.

The contour portion 22 of the contour assembly 20 may be formed with an upper protrusion or bulge 28 and a lower trigger 30. As disclosed in a number of applicant's patents cited by way of background above (e.g., U.S. Pat. No. 6,213,902 (hereinafter the "902 patent")), a handle contour such as the protrusion 28 provides a surface against which the saddle formed by the index finger and the thumb can be placed. This engagement, which is illustrated in FIGS. 7 and 8, locates the hand and/or acts as a pivotal point when changing from forehand to backhand grips and vice versa. As also disclosed in the '902 patent (and as illustrated in FIGS. 7 and 8), a handle contour such as the trigger 30 supports the player's index finger for added control and for increasing the player's awareness of his or her hand along the length of the handle.

As can be seen in FIG. 6, the protrusion 28 is preferably angled with respect to the central longitudinal axis of the racquet handle shaft 4. The protrusion 28 may also be conveniently located to one side of the handle shaft axis. This configuration (which is also disclosed in the '902 patent) forms a skewed planar surface 32. The surface 32 provides a natural surface for the base of the index finger when a continental grip is assumed and will act as a stop to limit hand rotation and/or correctly position the hand for backhand strokes.

As best shown in FIGS. 5 and 6, the base portion 24 of the contour assembly 20 is shaped to provide a hand grip area having the standard octagonal racquet handle configuration. The base portion 24 therefore includes a pair of side surfaces 34 and 36, a top surface 38, a bottom surface 40, and four diagonal surfaces 42. Because the contour assembly 20 slides over the handle shaft 4, it will be somewhat larger in size. However, by making the contour assembly 20 sufficiently thin, this should have minimal impact on player comfort.

With continuing reference to FIGS. 5 and 6, the head end portion 25 of the contour assembly 20 is also shaped to provide a hand grip area for making two-handed backhand strokes. The head end portion 25 may thus have the standard octagonal racquet handle configuration, including a pair of side surfaces 44 and 46, a top surface 48, a bottom surface 50, and four diagonal surfaces 52. Because the head end portion 25 covers the head end of the handle shaft 4, which is tapered, the head end portion 25 is also tapered at 54 to conform to the handle shaft contour. Note that an alternative embodiment of the contour assembly 20 may be provided by shortening or even eliminating the head end portion 25, thereby terminating the contour assembly at or somewhat beyond the head end of the contour portion 22.

Figure 8A:
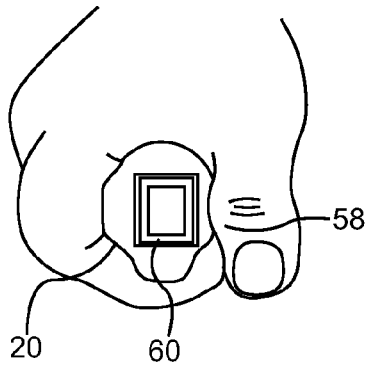
FIG. 8A is a cross-sectional view taken along line 8A-8A in FIG. 8 showing the racquet handle contour assembly of FIG. 5 mounted on a different racquet handle shaft.

As can be seen in FIG. 8, which shows the side opposite of that shown in FIG. 7, an enlarged area 56 of the contour portion 22 can be formed with a depression 58 in which a player's thumb is received. To accommodate the depression 58, the handle shaft 4 may need to be formed with a localized opening (not shown) that allows the depression to extend into the left side surface 8 thereof. Alternatively, as shown in FIG. 8A, the handle shaft 4 could be formed with a non-octagonal configuration 60, either locally at the depression 46, or throughout its length.

Figure 9:
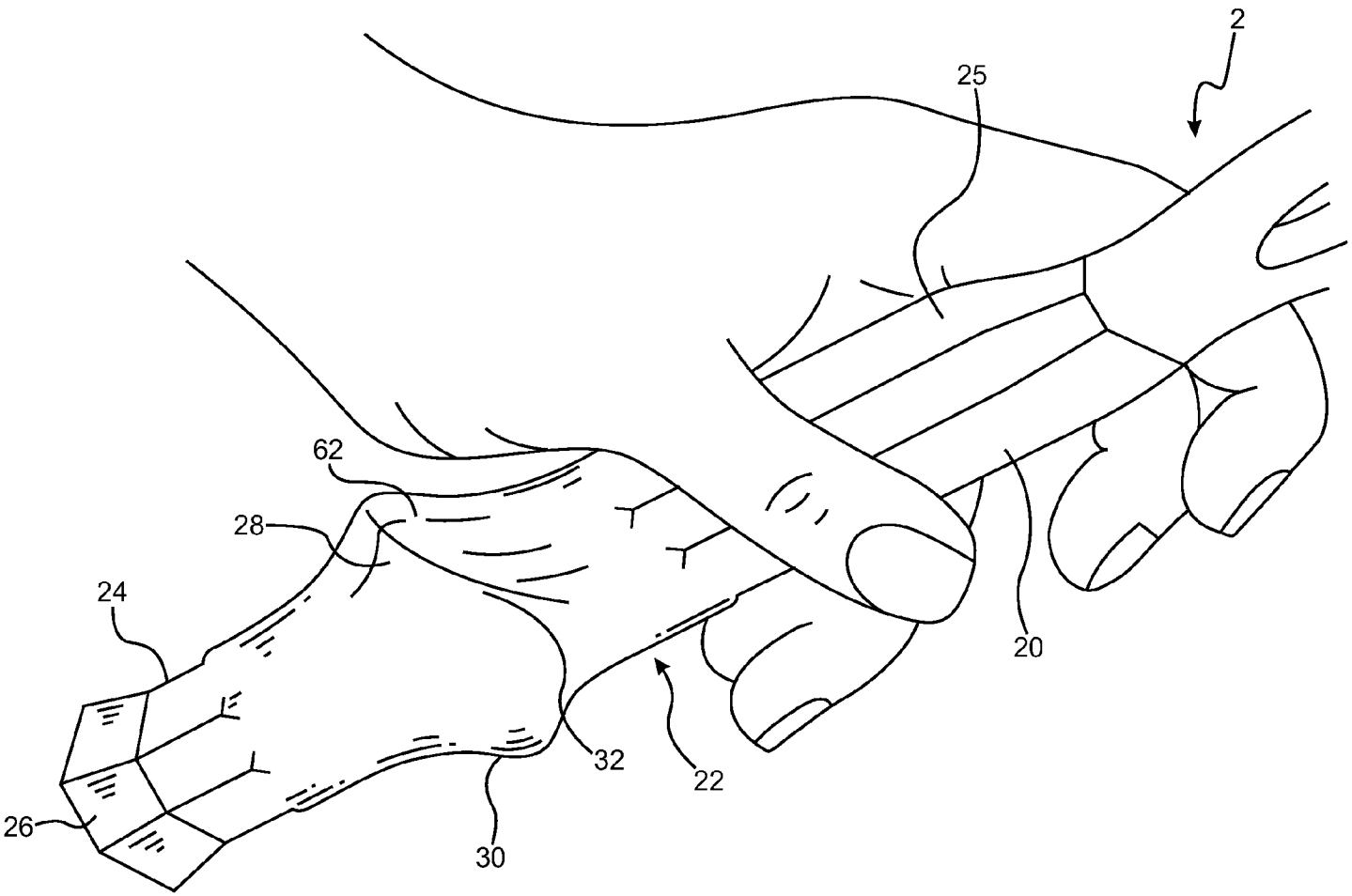
FIG. 9 is a perspective view showing the mounted racquet handle contour assembly of FIG. 5 being grasped by a left hand.

FIG. 9 shows a perspective view of the mounted contour assembly 20. This figure also illustrates how the head end 25 of the contour assembly 20 may be grasped by the left hand for making a two-handed backhand stroke. It will also be seen that the upper protrusion 28 provides an area 62 where the butt of the left hand may be placed to ensure proper hand positioning. Alternatively, instead of providing an octagonal head end 25, a second contour portion (not shown) with its own upper protrusion and lower trigger could be provided for accommodating the left hand. Note that the concept of using two contoured areas on a handle configuration is disclosed in applicant's '902 patent.

Figure 10A:
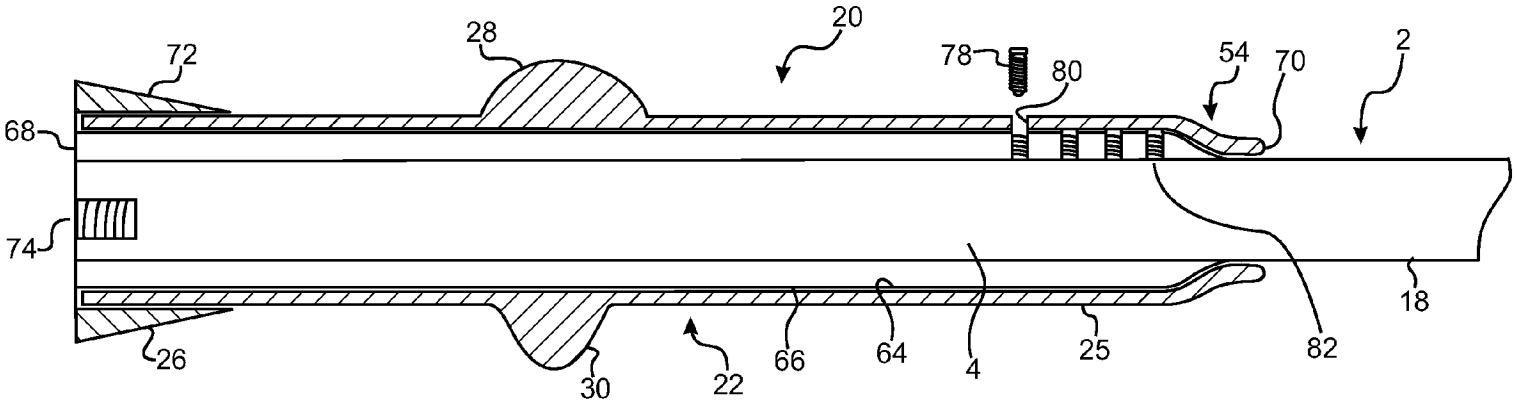
FIG. 10A is a cross-sectional view taken along line 10-10 in FIG. 6 showing the mounted racquet handle contour assembly of FIG. 5 in a first adjustment position.
Figure 10B:
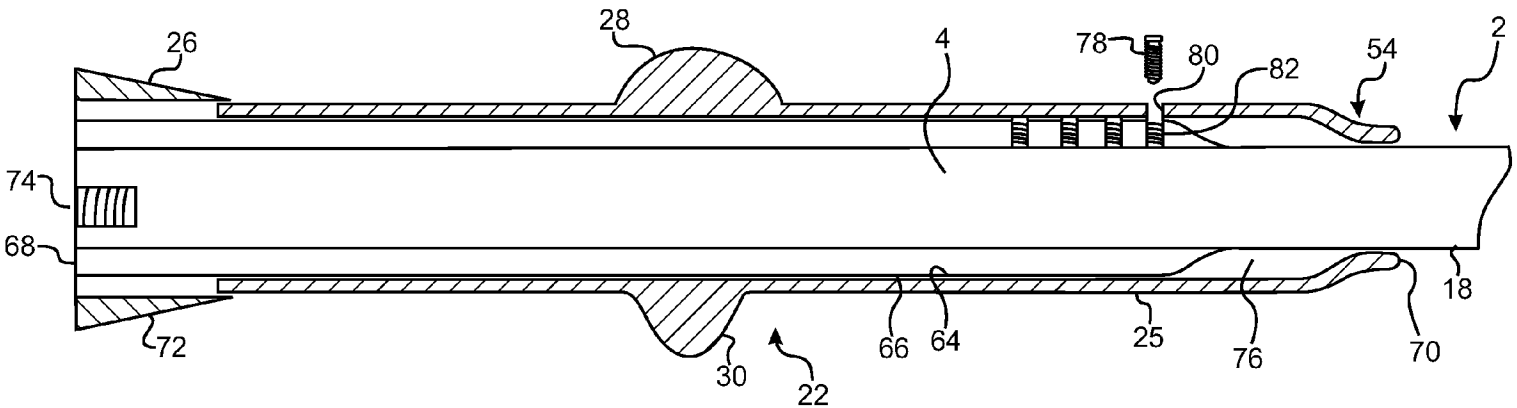
FIG. 10B is a cross-sectional view taken along line 10-10 in FIG. 6 showing the mounted racquet handle contour assembly of FIG. 5 in a second adjustment position.
Figure 11A:
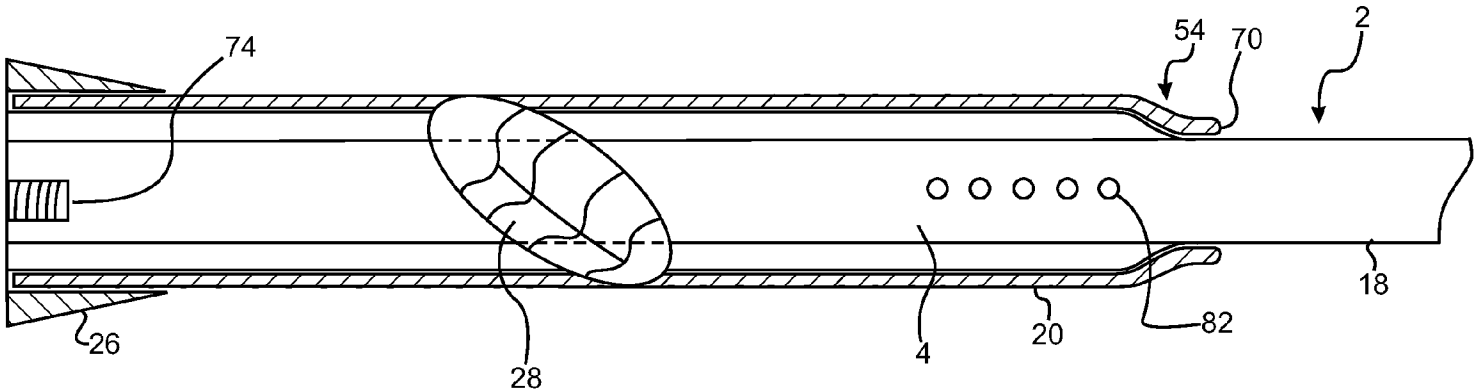
FIG. 11A is a cross-sectional view taken along line 11-11 in FIG. 5 showing the mounted racquet handle contour assembly of FIG. 5 in the first adjustment position.
Figure 11B:
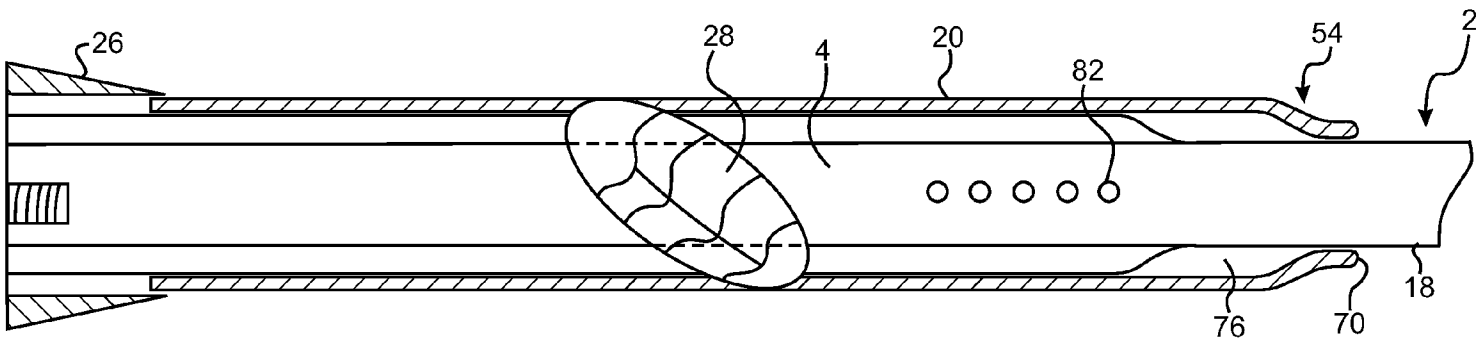
FIG. 11B is a cross-sectional view taken along line 11-11 in FIG. 5 showing the mounted racquet handle contour assembly of FIG. 5 in the second adjustment position.

Turning now to FIGS. 10A-11B, the construction of the contour assembly 20 as a slidable sleeve structure is shown in more detail. FIGS. 10A and 11A show a first slidable adjustment position in which the contour assembly 20 is closest to the butt cap 26. FIGS. 10B and 11B show a second slidable adjustment position in which the contour assembly 20 is closest to the racquet head (not shown). As described in more detail below, the contour assembly 20 may also have multiple intermediate adjustment positions.

To provide structural rigidity, the contour assembly 20 may be fabricated from molded plastic or other suitable material (e.g., metal, fiberglass, graphite, etc.), and can be provided with a cushioned outer surface made from rubber, foam or other materials to provide hand comfort. Alternatively, the contour assembly 20 could be wrapped with racquet handle tape. The outside surface shape of the contour assembly 20 has been previously discussed. An inside surface 64 of the contour assembly 20 defines a hollow interior region 66 that is shaped to closely match the configuration and size of the handle shaft 4. The contour assembly 20 further includes a base end 68 at the terminus of the base portion 24 and a head end 70 at the terminus of the head end portion 25.

The base end 68 of the contour assembly 20 always remains covered by a side wall 72 of the butt cap 26. To that end, the side wall 72 should be long enough to cover the base end 68 when the contour assembly 20 is at its final adjustment position in the direction of the racquet head. As stated, this is the adjustment position shown in FIGS. 10B and 11B. The butt cap 26 is also sized in terms of its cross-sectional area to provide a suitable gap between the handle shaft 4 and the inner surface of the side wall 72 for receiving the contour assembly's base end 68. A screw 74 or another type of fastener or a mechanical attachment arrangement may be used to removably secure the butt cap 26 to the base end of the handle shaft 4. Alternatively, if it is not necessary to remove the butt cap 26 after the contour assembly 20 has been mounted, the butt cap could be permanently affixed to the handle shaft 4, as by adhesive, stapling, etc.

As previously described, the head end portion 25 of the contour assembly 20 may be tapered. This allows the head end portion 25 to conform to the taper of the octagonal handle shaft 4 as it transitions to the rectangular neck section configuration of the racquet 2. It will be appreciated that if the head end portion 25 is configured in this manner, it will be smaller in size than the main octagonal portion of the handle shaft 4. Thus, special design accommodation will be required in order to mount the contour assembly 20. For example, the contour assembly 20 could be formed from two (or more) separate pieces that are assembled in place over the handle shaft 4. Alternatively, the contour assembly 20 may be mounted as unitary and non-segmented structure, or as a pre-assembled structure made from several pieces. In that case, the head end portion 25 can be made from an expandable material so that it can be stretched over the base end of the handle shaft 4, thereby allowing the contour assembly 20 to be slid into place. Alternatively, the head end portion 25 will not be tapered. This will allow the contour assembly 20 to be slid on and off the handle shaft 4 from its base end after removing the butt cap 26. However, if the contour assembly 20 is long enough to reach the racquet neck section 18 in one or more adjustment positions, providing a tapered head end portion 25 will provide a cleaner look by allowing the head end 70 to follow the contour of the neck section and close the air space 76 shown in FIGS. 10B and 11B.

As can be seen by comparing FIGS. 10A and 11A to FIGS. 10B and 11B, the contour assembly 20 is slidable along the handle shaft 4 in order to adjust the position of the contour portion 22 and change the length of the base portion 24. In FIGS. 10A and 11A, the base portion 24 is relatively short and the contour portion 22 is relatively close to the butt cap 26. In FIGS. 11A and 11B, the base portion 24 is relatively long and the contour portion 22 is relatively far from the butt cap 26. To fix the contour assembly 20 in position, a set screw 78 or other fastener is inserted through a hole 80 formed in the head end portion 25. The set screw 78 is threaded or otherwise affixed in one of a series of mounting apertures, such as screw holes 82, formed in the top surface 12 of the handle shaft 4. The left-hand mounting hole 82 is used to lock the contour assembly 20 in the position shown in FIGS. 10A and 11A. The right-hand mounting hole 82 is used to lock the contour assembly 20 in the position shown in FIGS. 10B and 11B. As previously stated, the contour assembly 20 can also be positioned in multiple intermediate positions between the two positions shown in FIGS. 10A-11B. These positions are defined by the intermediate mounting holes 82, two of which are shown in FIGS. 10A and 10B, and three of which are shown in FIGS. 11A and 11B.

Figure 12:
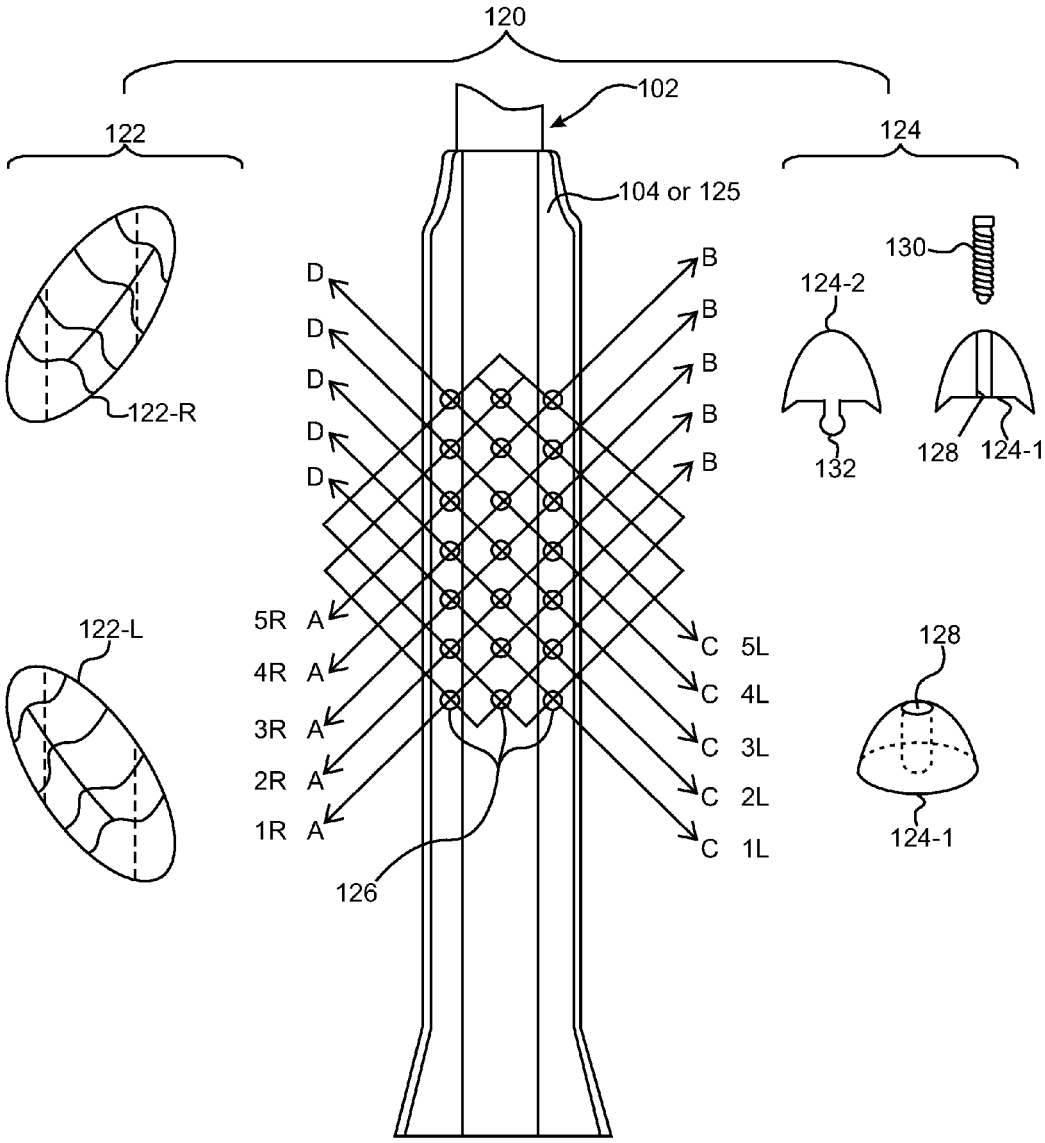
FIG. 12 is a top plan view showing a racquet handle contour assembly mounted on a racquet handle shaft according to another example embodiment disclosed herein.

Turning now to FIG. 12, a racquet 102 having an octagonal handle shaft 104 is shown mounting an alternative contour assembly embodiment 120. In this embodiment, the contour assembly 120 includes an upper protrusion member 122 and a lower trigger member 124 formed as discrete structural members. The protrusion member 122 and the trigger member 124 are separately mountable on the racquet handle shaft 104. Alternatively, the protrusion member 122 and the trigger member 124 could be mounted on an octagonal sleeve 125 that slides over the handle shaft 4. The sleeve 125 could be constructed similar to the contour assembly 20 of the previous embodiment, except without the contour portion 22. It could be mounted to the handle shaft 104 in the same manner. The sleeve 125 would then effectively become a substitute outer handle shaft to which the contour assembly 120 is mounted, with the substitute handle shaft 125 being slidably positionable along the underlying inner handle shaft 104. The racquet 102 itself may be of the same design as the racquet 2 of the previous embodiment.

Figure 13A:
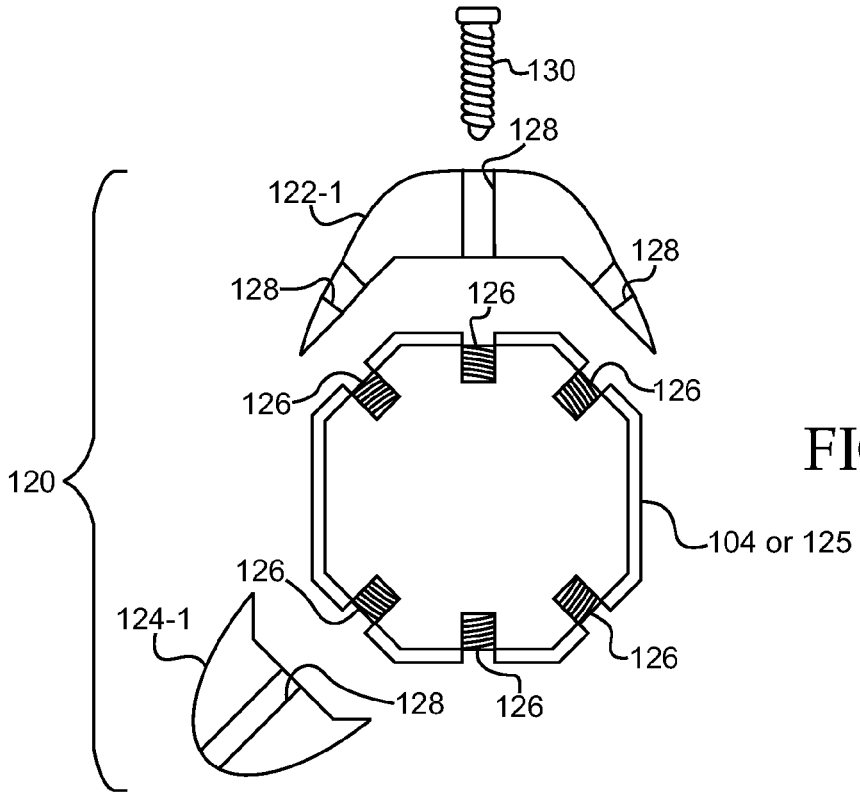
FIG. 13A is a cross-sectional view showing a first mounting arrangement of the racquet handle contour assembly of FIG. 12.
Figure 13B:
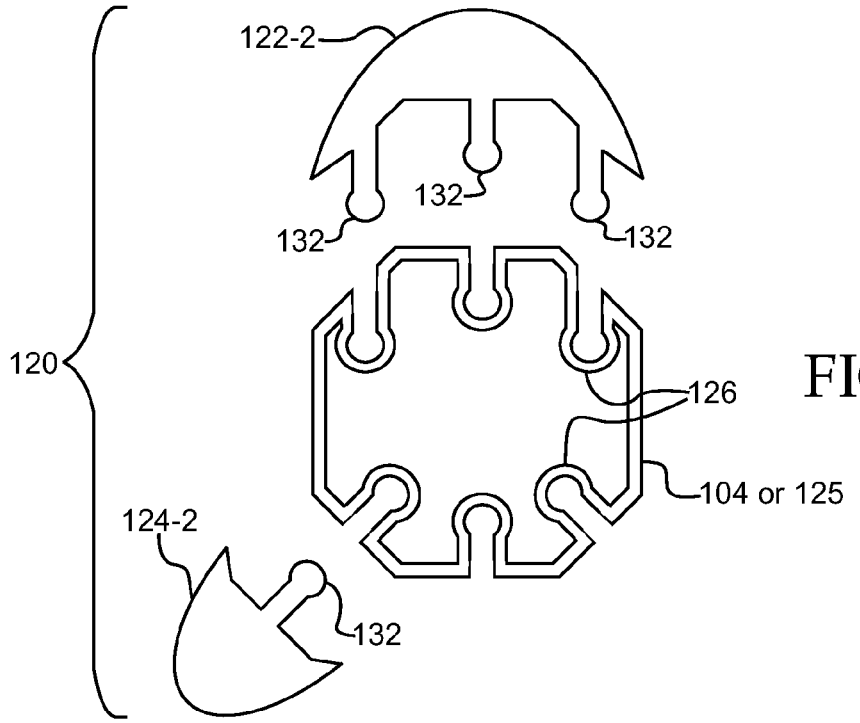
FIG. 13B is a cross-sectional view showing a second mounting arrangement of the racquet handle contour assembly of FIG. 12.

As additionally shown in FIGS. 13A and 13B, the protrusion member 122 may be formed as an elongated convex ridge member, and the trigger member 124 can be formed as a convex dome member. Each such member protrudes from the surrounding surface on which it is mounted as a raised structure. In this configuration, there is only enough structure to provide the protrusion and the trigger itself. There is no ancillary or transition structure extending in any direction that does not actually form part of the raised protrusion or trigger. The interior or underside of the protrusion member 122 and the trigger member 124 conforms to the handle shaft shape (or sleeve shape) at the location(s) at which these members are mounted.

Any suitable rigid material may by used to construct the protrusion member 122 and the trigger member 124, including plastic, metal, fiberglass, graphite, etc. The outer surface of the protrusion member 122 and the trigger member 124 may be provided with a soft cushioning material for hand comfort. Suitable materials include rubber, foam, etc. Alternatively, racquet tape could be used to cover the protrusion member 122 and the trigger member 124 after they are mounted on the racquet 102.

In order to mount the contour assembly 120, one or more sets of mounting apertures 126 may be formed in the handle shaft 104 (or sleeve 125 if it is present). In particular, the mounting apertures 126 can be formed on the top surface of the handle shaft 104 (or the top surface of sleeve 125), and also in the two adjacent diagonal surfaces of the handle shaft (or diagonal surfaces of the sleeve). As shown in FIGS. 13A and 13B, a similar array of mounting apertures 126 may formed in the bottom surface of the handle shaft 104 (or the bottom surface of sleeve 125), and also in the two adjacent diagonal surfaces of the handle shaft (or diagonal surfaces of the sleeve). The mounting apertures 126 can be positioned in a manner that allows the contour assembly 120 to be mounted for either a right-handed or left-handed player, and also according to the size of the player's hand. Thus, the player can personalize the racquet 102 according to his or her liking.

As shown in FIGS. 13A and 13B, the protrusion member 122 may be attached to the handle shaft 104 (or sleeve 125) using three attachment apertures 126. Alternatively, two attachment apertures 126 may also suffice. Because the protrusion member 122 will normally be mounted on an angle with respect to the central longitudinal axis of the handle shaft 104 (or sleeve 125), the mounting apertures 126 may be aligned in angled rows arranged on lines A-B and C-D in FIG. 12. Lines A-B are for right-handed players and lines C-D are for left-handed players. By way of example only, FIG. 12 shows five rows of mounting apertures 126 respectively situated on A-B lines 1R, 2R, 3R, 4R and 5R (the letter R signifying right-handed mounting). These mounting aperture rows are for mounting the protrusion member 122 when it is in the configuration labeled 122-R on the left side of FIG. 12. Similarly, FIG. 12 shows five rows of mounting apertures 126 respectively situated on C-D lines 1L, 2L, 3L, 4L and 5L (the letter L signifying left-handed mounting). These mounting aperture rows are for mounting the protrusion member 122 when it is in the configuration labeled 122-L on the left side of FIG. 12.

As further shown in FIG. 12, and also in FIGS. 13A and 13B, the trigger member 124 requires only a single mounting aperture 126, although more could be used depending on the trigger member's size. The mounting apertures 126 used for mounting the trigger member 124 may be formed using the same pattern as the apertures used to mount the protrusion member 122. Providing the same pattern allows to player to chose between mounting the trigger member 124 on the bottom surface of the handle shaft 104 (or the bottom surface of sleeve 125), or on one of the two adjacent diagonal surfaces of the handle shaft (or diagonal surfaces of the sleeve). This allows the trigger member 124 to be set up for either right-handed or left-handed players, or for use by either type of player (i.e., by using the bottom surface mounting location).

The right side of FIG. 12, as well as FIGS. 13A and 13B, illustrate two alternative techniques that may be used to mount the protrusion member 122 and the trigger member 124 to the handle shaft 104 (or sleeve 122). A first alternative protrusion member 122-1 and trigger member 124-1 are formed with through-holes 128 that receive a screw 130 or other fastener that threads or is otherwise installed into the mounting apertures 124, which may be formed as screw holes for this embodiment. As shown in FIG. 13A, the protrusion member 122-1 may be formed with several (e.g., two or three) through-holes 128 whereas the trigger member 124-1 may only require one through hole.

A second alternative protrusion member 122-2 and trigger member 124-2 are formed with snap-prongs 132 that are designed to snap into the mounting apertures 126, which are formed as snap receptacles for this embodiment. As shown in FIG. 13B, the latter may be specially formed to lock the snap-prongs 132 following mounting. Again, the protrusion member 122-2 may be formed with several (e.g., two or three) snap-prongs 132 whereas the trigger member 124-2 may only require one snap-prong.

Accordingly, contoured hand grip constructions for a racquet have been disclosed. Although various embodiments of the invention have been described, it should be apparent that many variations and alternative embodiments could be implemented in accordance with the invention. It is understood, therefore, that the invention is not to be in any way limited except in accordance with the spirit of the appended claims and their equivalents.

What is claimed is:

1. A handle configuration for a racquet that supports a stringed racquet head at its outer end and is terminated at a handle base or butt end, comprising:

a racquet handle shaft having a defined exterior shape;

a butt cap at said butt end of said racquet handle shaft;

a plurality of mounting apertures in said racquet handle shaft;

a contour assembly having an exterior of designed contour, including an upper protrusion and a lower trigger, said contour assembly being mountable on said racquet handle shaft at a plurality of discrete locations defined by said mounting apertures;

said upper protrusion being located at a top side of said racquet handle shaft and being angled with respect to a central longitudinal axis of said racquet handle shaft to provide a surface against which a saddle formed by an index finger and a thumb of a player's hand is placed;

said lower trigger being located at a bottom side of said racquet handle shaft to provide a surface against which an index figure of a player's hand is placed;

said contour assembly having an interior shape conforming to said handle shaft shape to allow said contour assembly to be received on said handle shaft for attachment thereto;

one or more mounting elements on said contour assembly configured to align with said handle shaft mounting apertures for attachment of said contour assembly thereto; and said contour assembly being selected from the group consisting of:

(1) a contour assembly comprising a sleeve surrounding said racquet handle shaft, said sleeve being formed with a contour portion defining said upper protrusion and said lower trigger and a base portion defining a hand grip area for grasping said contour assembly with a hand while portions of said hand engage said upper protrusion and said lower trigger, said sleeve being slidably received in said butt cap such that said base portion can be lengthened or shortened according to a mounting position of said contour assembly on said racquet handle shaft; or (2) a contour assembly wherein said upper protrusion and said lower trigger respectively comprise an upper protrusion member and a lower trigger member formed as discrete structural members that are separately mountable to said racquet handle shaft, said upper protrusion member being formed as a raised ridge member and said trigger member being formed as a raised dome member with no ancillary structure being associated with either member, each said member having its own said one or more mounting elements.

2. The handle configuration of claim 1, wherein said racquet handle shaft comprises an octagonal shape.

3. The handle configuration of claim 2, wherein said mounting apertures are formed on a top and bottom surface of said racquet handle shaft, and on adjacent diagonal surfaces of said handle shaft.

4. The handle configuration of claim 1, wherein said racquet handle shaft comprises an outer handle shaft sleeve mounted over an inner racquet handle shaft.

5. The handle configuration of claim 1, wherein said butt cap is removably mounted to said racquet handle shaft.

6. The handle configuration of claim 1, wherein said mounting apertures comprise holes and said one or more mounting elements comprise removable fasteners.

7. The handle configuration of claim 1, wherein said mounting apertures comprise snap receptacles and said one or more mounting elements comprise snap-prongs.

8. The handle configuration of claim 1, wherein said mounting apertures are formed on a top surface of said racquet handle shaft.

9. The handle configuration of claim 1, wherein said mounting apertures are formed on a top surface and a bottom surface of said racquet handle shaft.

10. The handle configuration of claim 1, wherein said contour assembly sleeve comprises a unitary, non-segmented structure.

11. The handle configuration of claim 1, wherein said base portion of said contour assembly sleeve comprises an octagonal shape.

12. The handle configuration of claim 1, wherein said contour assembly sleeve further comprises a head end portion extending from a head end of said contour portion, said head end portion defining a hand grip area for grasping said contour assembly with a hand during a two-handed backhand stroke.

13. The handle configuration of claim 12, wherein said racquet handle shaft comprises a tapered head end and wherein said contour assembly sleeve comprises a corresponding tapered head end.

14. The handle configuration of claim 1, wherein said head end portion of said contour assembly sleeve comprises an octagonal shape.

15. The handle configuration of claim 1, wherein said contour assembly sleeve extends from within said butt cap to a neck section of said racquet in order to completely cover said racquet handle shaft.

16. The handle configuration of claim 1, wherein said mounting apertures used for mounting said upper protrusion member are arranged in angled rows.

17. The handle configuration of claim 1, wherein said mounting apertures used for mounting said upper protrusion member are arranged in a first set of angled rows that mount said upper protrusion member for right-handed players and a second set of angled rows that mount said upper protrusion member for left-handed players.

18. The handle configuration of claim 1, wherein said mounting apertures used for mounting said lower trigger member are arranged to allow said lower trigger member to be mounted to for either right-handed players, left-handed players, or both.

19. A handle configuration for a racquet that supports a stringed racquet head at its outer end and is terminated at a handle base or butt end, comprising:

a racquet handle shaft having a defined exterior shape;

a butt cap at said butt end of said racquet handle shaft;

a plurality of mounting apertures in said racquet handle shaft;

a contour assembly having an exterior of designed contour, including an upper protrusion and a lower trigger, said contour assembly being mountable on said racquet handle shaft at a plurality of discrete locations defined by said mounting apertures;

said upper protrusion being located at a top side of said racquet handle shaft and being angled with respect to a central longitudinal axis of said racquet handle shaft to provide a surface against which a saddle formed by an index finger and a thumb of a player's hand is placed;

said lower trigger being located at a bottom side of said racquet handle shaft to provide a surface against which an index figure of a player's hand is placed;

said contour assembly having an interior shape conforming to said handle shaft shape to allow said contour assembly to be received on said handle shaft for attachment thereto;

one or more mounting elements on said contour assembly configured to align with said handle shaft mounting apertures for attachment of said contour assembly thereto; and said contour assembly further comprising a sleeve surrounding said racquet handle shaft, said sleeve being formed with a contour portion defining said upper protrusion and said lower trigger and a base portion defining a hand grip area for grasping said contour assembly with a hand while portions of said hand engage said upper protrusion and said lower trigger, said sleeve being slidably received in said butt cap such that said base portion can be lengthened or shortened according to a mounting position of said contour assembly on said racquet handle shaft.

20. A handle configuration for a racquet that supports a stringed racquet head at its outer end and is terminated at a handle base or butt end, comprising:

a racquet handle shaft having a defined exterior shape;

a butt cap at said butt end of said racquet handle shaft;

a plurality of mounting apertures in said racquet handle shaft;

a contour assembly having an exterior of designed contour, including an upper protrusion and a lower trigger, said contour assembly being mountable on said racquet handle shaft at a plurality of discrete locations defined by said mounting apertures;

said upper protrusion being located at a top side of said racquet handle shaft and being angled with respect to a central longitudinal axis of said racquet handle shaft to provide a surface against which a saddle formed by an index finger and a thumb of a player's hand is placed;

said lower trigger being located at a bottom side of said racquet handle shaft to provide a surface against which an index figure of a player's hand is placed;

said contour assembly having an interior shape conforming to said handle shaft shape to allow said contour assembly to be received on said handle shaft for attachment thereto;

one or more mounting elements on said contour assembly configured to align with said handle shaft mounting apertures for attachment of said contour assembly thereto; and said upper protrusion and said lower trigger respectively comprising an upper protrusion member and a lower trigger member formed as discrete structural members that are separately mountable to said racquet handle shaft, said upper protrusion member being formed as a raised ridge member and said trigger member being formed as a raised dome member with no ancillary structure being associated with either member, each said member having its own said one or more mounting elements.

* * * * *